US011754323B2

(12) United States Patent
Chow et al.

(10) Patent No.: US 11,754,323 B2
(45) Date of Patent: Sep. 12, 2023

(54) ASYNCHRONOUS DRIVE OF CRYOCOOLING SYSTEMS FOR LOW TEMPERATURE APPLICATIONS

(71) Applicant: International Business Machines Corporation, Armonk, NY (US)

(72) Inventors: Jerry M. Chow, Scarsdale, NY (US); Patryk Gumann, Tarrytown, NY (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 323 days.

(21) Appl. No.: 17/145,010

(22) Filed: Jan. 8, 2021

(65) Prior Publication Data

US 2022/0221198 A1 Jul. 14, 2022

(51) Int. Cl.
*F25B 9/14* (2006.01)
*F25B 9/10* (2006.01)

(52) U.S. Cl.
CPC ..... *F25B 9/145* (2013.01); *F25B 9/10* (2013.01); *F25B 2309/1411* (2013.01); *F25B 2309/1424* (2013.01); *F25B 2500/13* (2013.01)

(58) Field of Classification Search
CPC ..... F25B 2309/1411; F25B 2309/1427; F25B 2309/1428; F25B 9/14; F25B 2500/13
See application file for complete search history.

(56) References Cited

U.S. PATENT DOCUMENTS

| | | | | |
|---|---|---|---|---|
| 5,412,951 | A | 5/1995 | Wu | |
| 5,836,165 | A | 11/1998 | Champion et al. | |
| 7,779,640 | B2 * | 8/2010 | Price | F25B 9/14 318/128 |
| 2014/0325999 | A1 * | 11/2014 | Hope | F25D 19/006 62/6 |
| 2016/0050490 | A1 | 2/2016 | Bruckman et al. | |
| 2020/0363014 | A1 | 11/2020 | Hart et al. | |

OTHER PUBLICATIONS

International Search Report and Written Opinion received for PCT Application Serial No. PCT/EP2022/050162 dated Apr. 19, 2022, 9 pages.

* cited by examiner

*Primary Examiner* — Lionel Nouketcha
(74) *Attorney, Agent, or Firm* — Amin, Turocy & Watson, LLP

(57) ABSTRACT

Techniques facilitating mechanical vibration management for cryogenic environments are provided. In one example, a system can comprise a processor that executes computer executable components stored in memory. The computer executable components can comprise a linearization component and a drive component. The linearization component can translate data indicative of a nonlinear drive signal into a linear drive signal. The drive component can dynamically control operation of a compressor of a cryocooler using the linear drive signal. The cryocooler can provide cooling capacity for a cryogenic environment.

20 Claims, 8 Drawing Sheets

ASYNCHRONOUS DRIVE OF CRYOCOOLING SYSTEMS FOR LOW TEMPERATURE APPLICATIONS

BACKGROUND

The subject disclosure relates to cryogenic environments, and more specifically, to techniques of facilitating mechanical vibration management for cryogenic environments.

SUMMARY

The following presents a summary to provide a basic understanding of one or more embodiments of the invention. This summary is not intended to identify key or critical elements, or delineate any scope of the particular embodiments or any scope of the claims. Its sole purpose is to present concepts in a simplified form as a prelude to the more detailed description that is presented later. In one or more embodiments described herein, systems, devices, computer-implemented methods, and/or computer program products that facilitate mechanical vibration management for cryogenic environments are described.

According to an embodiment, a system can comprise a processor that executes computer executable components stored in memory. The computer executable components can comprise a linearization component and a drive component. The linearization component can translate data indicative of a nonlinear drive signal into a linear drive signal. The drive component can dynamically control operation of a compressor of a cryocooler using the linear drive signal. The cryocooler can provide cooling capacity for a cryogenic environment.

According to another embodiment, a computer-implemented method can comprise translating, by a system operatively coupled to a processor, data indicative of a nonlinear drive signal into a linear drive signal. The computer-implemented method can further comprise dynamically controlling, by the system, operation of a compressor of a cryocooler using the linear drive signal. The cryocooler can provide cooling capacity for a cryogenic environment.

According to another embodiment, a computer program product can comprise a computer readable storage medium having program instructions embodied therewith. The program instructions are executable by a processor to cause the processor to perform operations. The operations can include translate, by the processor, data indicative of a nonlinear drive signal into a linear drive signal. The operations can further include dynamically control, by the processor, operation of a compressor of a cryocooler using the linear drive signal. The cryocooler can provide cooling capacity for a cryogenic environment.

DETAILED DESCRIPTION

The following detailed description is merely illustrative and is not intended to limit embodiments and/or application or uses of embodiments. Furthermore, there is no intention to be bound by any expressed or implied information presented in the preceding Background or Summary sections, or in the Detailed Description section.

One or more embodiments are now described with reference to the drawings, wherein like referenced numerals are used to refer to like elements throughout. In the following description, for purposes of explanation, numerous specific details are set forth in order to provide a more thorough understanding of the one or more embodiments. It is evident, however, in various cases, that the one or more embodiments can be practiced without these specific details.

Figure 1:
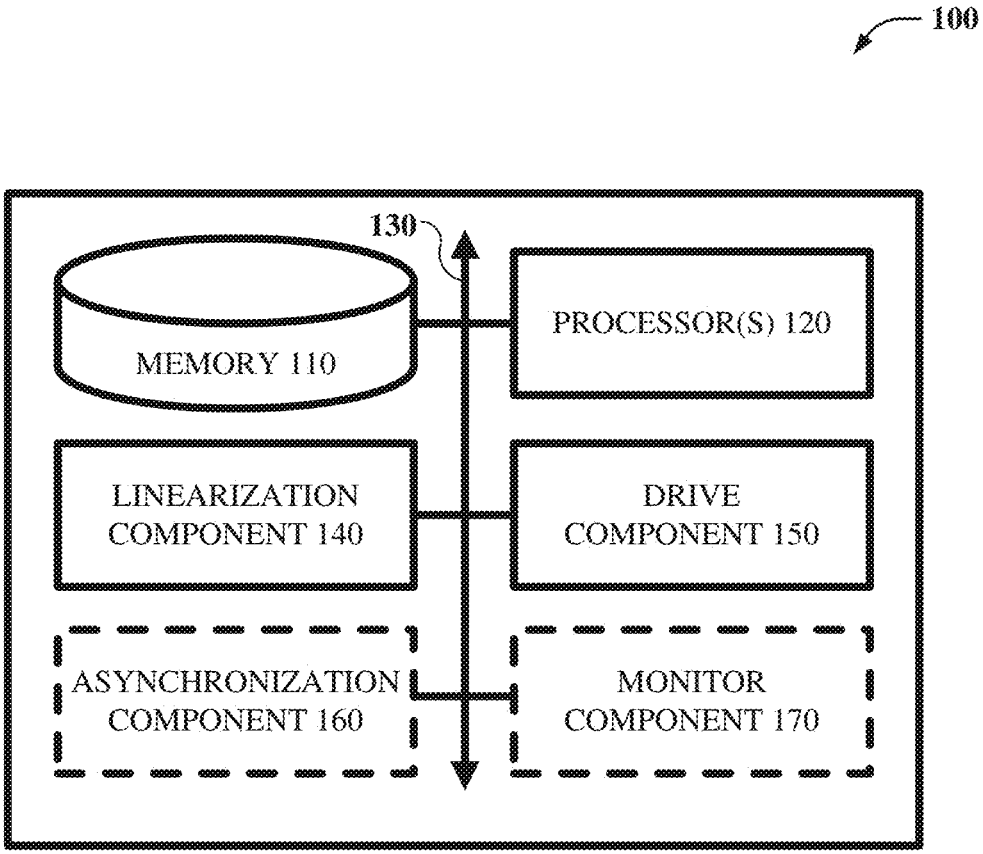
FIG. 1 illustrates a block diagram of an example, non-limiting system that can facilitate mechanical vibration management for cryogenic environments, in accordance with one or more embodiments described herein.

FIG. 1 illustrates a block diagram of an example, non-limiting system 100 that can facilitate mechanical vibration management for cryogenic environments, in accordance with one or more embodiments described herein. System 100 includes memory 110 for storing computer-executable components and one or more processors 120 operably coupled via one or more communication busses 130 to memory 110 for executing the computer-executable components stored in memory 110. As shown in FIG. 1, the computer-executable components can include linearization component 140 and drive component 150.

Linearization component 140 can translate data indicative of a nonlinear drive signal into a linear drive signal. For example, linearization component 140 can receive a nonlinear drive signal and convert the nonlinear drive signal into a linear drive signal. Drive component 150 can dynamically control operation of a compressor of a cryocooler using the linear drive signal. The cryocooler can provide cooling capacity for a cryogenic environment. In an embodiment, the cryocooler can be a regenerative cryocooler. In an embodiment, the cryocooler can be a Stirling cryocooler, a pulse tube cryocooler, and/or a Gifford McMahon cryocooler. In an embodiment, drive component 150 can modify the linear drive signal to terminate operation of the compressor when an operational state of the cryocooler transitions from a healthy operational state to a failing operational state.

In an embodiment, the computer-executable components stored in memory 110 can further include asynchronization component 160 and monitor component 170. Asynchronization component 160 can modify a phase of the linear drive signal relative to a corresponding phase of a drive signal associated with an additional cryocooler based on a feedback signal. The feedback signal can be generated using sensor data indicative of mechanical vibrations associated with the cryogenic environment. The drive signal can control operation of a corresponding compressor of the additional cryocooler that provides cooling capacity for the cryogenic environment. In an embodiment, asynchronization component 160 can modify the phase of the linear drive signal to facilitate asynchronous operation of the compressor and the corresponding compressor.

Monitor component 170 can generate a feedback signal using sensor data indicative of mechanical vibrations associated with the cryogenic environment. In an embodiment, monitor component 170 can identify an operational state of the cryocooler by evaluating an operational parameter of the cryocooler. In an embodiment, the operational parameter can include: a low-pressure level of a coolant medium, a high-pressure level of the coolant medium, a pressure differential, a compressor temperature, a cold head temperature, a cold head vibration level, or a combination thereof. The functionality of the computer-executable components utilized by the embodiments will be covered in greater detail below.

Figure 2:
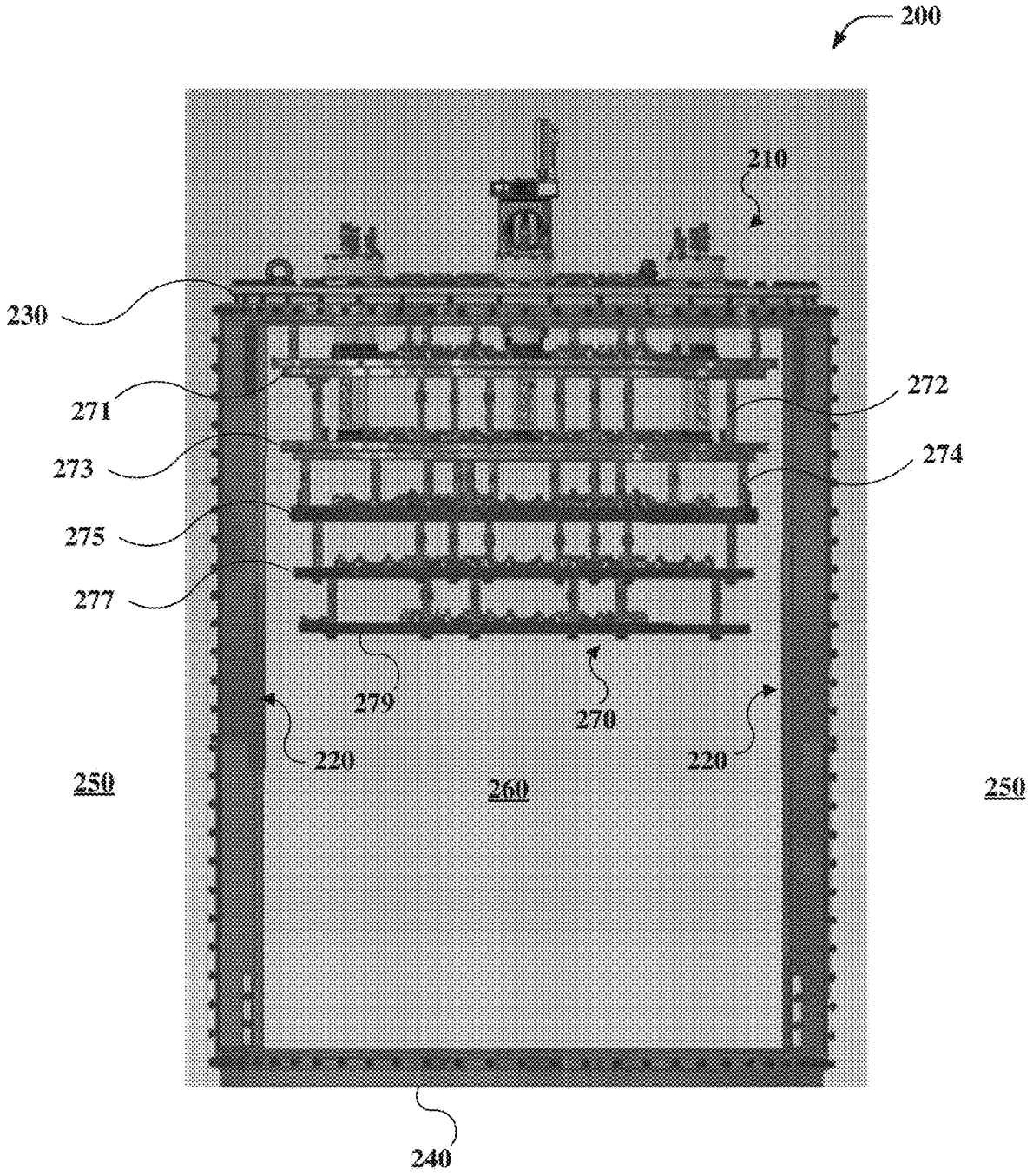
FIG. 2 illustrates an example, non-limiting cryostat, in accordance with one or more embodiments described herein.

FIG. 2 illustrates an example, non-limiting cryostat 200, in accordance with one or more embodiments described herein. As shown in FIG. 2, cryostat 200 comprises an outer vacuum chamber 210 formed by a sidewall 220 intervening between a top plate 230 and a bottom plate 240. In operation, outer vacuum chamber 210 can maintain a pressure differential between an ambient environment 250 of outer vacuum chamber 210 and an interior 260 of outer vacuum chamber 210. Cryostat 200 further comprises a plurality of thermal stages (or stages) 270 disposed within interior 260 that are each mechanically coupled to top plate 230. The plurality of stages 270 includes: stage 271, stage 273, stage 275, stage 277, and stage 279. Each stage among the plurality of stages 270 can be associated with a different temperature. For example, stage 271 can be a 50-kelvin (50-K) stage that is associated with a temperature of 50 kelvin (K), stage 273 can be a 4-kelvin (4-K) stage that is associated with a temperature of 4 K, stage 275 can be associated with a temperature of 700 millikelvin (mK), stage 277 can be associated with a temperature of 100 mK, and stage 279 can be associated with a temperature of 10 mK. Each stage among the plurality of stages 270 is spatially isolated from other stages of the plurality of stages 270 by a plurality of support rods (e.g., support rods 272 and 274). In an embodiment, stage 275 can be a Still stage, stage 277 can be a Cold Plate stage, and stage 279 can be a Mixing Chamber stage.

Figure 3:
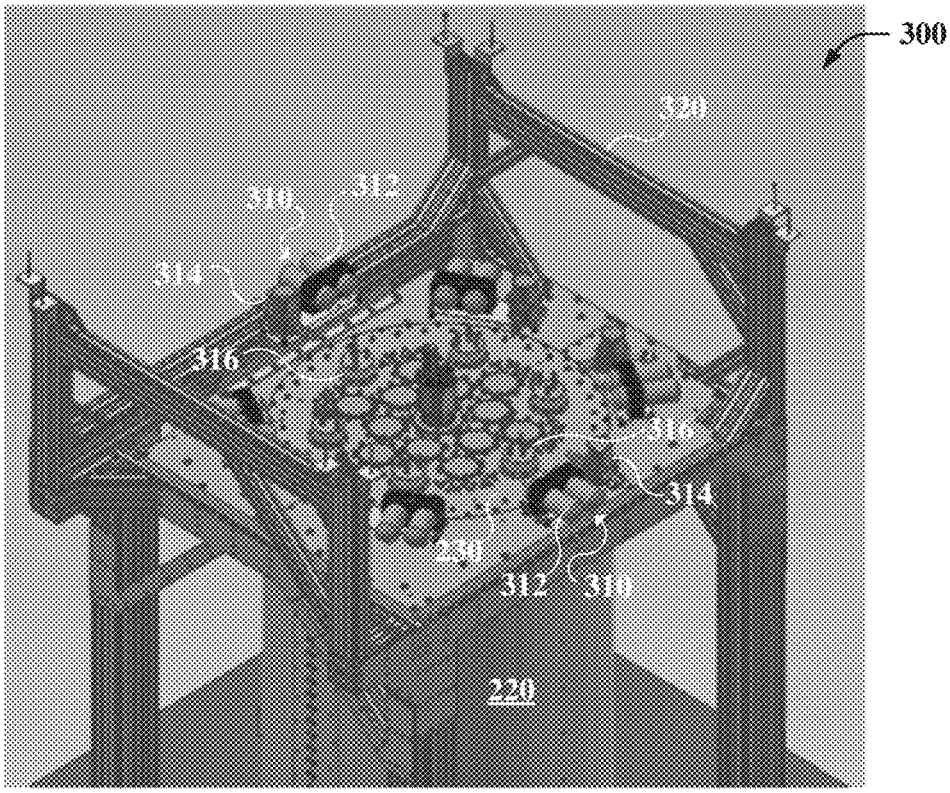
FIG. 3 illustrates an example, non-limiting isometric view depicting multiple pulse tube systems coupled with the cryostat of FIG. 2, in accordance with one or more embodiments described herein.

FIG. 3 illustrates an example, non-limiting isometric view 300 depicting multiple pulse tube systems 310 coupled with the cryostat 200 of FIG. 2, in accordance with one or more embodiments described herein. As shown by FIG. 3, each pulse tube system 310 includes a pair of buffer volumes 312 and a motor head 314 positioned on a frame structure 320 providing mechanical support to cryostat 200. Each pulse tube system 310 further includes a pulse tube head 316 positioned on top plate 230 of cryostat 200. One skilled in the art will recognize that each pulse tube system 310 can be coupled with a compressor (not shown) to form a cryocooler providing cooling capacity for cryostat 200. In an embodiment, the cryocooler can be a regenerative cryocooler. In an embodiment, the cryocooler can be a Stirling cryocooler, a pulse tube cryocooler, and/or a Gifford McMahon cryocooler.

Figure 4:
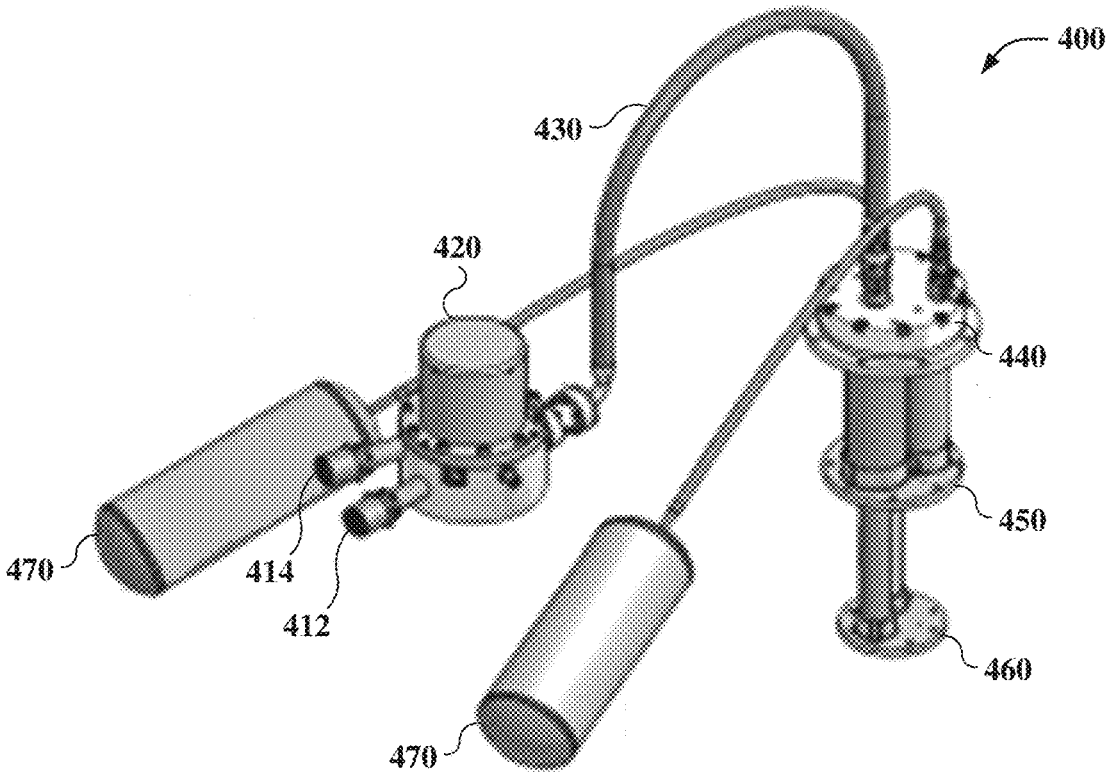
FIG. 4 illustrates an example, non-limiting pulse tube system, in accordance with one or more embodiments described herein.

FIG. 4 illustrates an example, non-limiting pulse tube system 400, in accordance with one or more embodiments described herein. As shown by FIG. 4, pulse tube system 400 comprises a high-pressure inlet 412, a low-pressure inlet 414, a motor head 420, a motor line 430, a top plate flange 440, a 50-K stage flange 450, a 4-K stage flange 460, and buffer volumes 470. High-pressure inlet 412 and low-pressure inlet 414 can couple pulse tube system 400 to an outlet port and an inlet port of a compressor, respectively. High-pressure inlet 412 and low-pressure inlet 414 can couple a rotary valve of motor head 420 with the outlet and inlet ports of the compressor, respectively. Top plate flange 440 can couple to a top plate of an outer vacuum chamber at room temperature. For example, top plate flange 440 can couple to top plate 230 of outer vacuum chamber 210. 50-K stage flange 450 and 4-K stage flange 460 can each couple to thermal stages of a cryostat enclosed within the outer vacuum chamber. For example, 50-K stage flange 450 and 4-K stage flange 460 can couple to stages 271 and 273 of cryostat 200, respectively.

In operation, high-pressure coolant medium can be supplied to a high-pressure inlet 412 and low-pressure coolant medium can be pumped from a low-pressure inlet 414 responsive to a drive signal that the compressor receives at an input to control operation of the compressor. Example coolant mediums can include helium, hydrogen, nitrogen, and the like. A rotary valve of motor head 420 alternatively connects a low-pressure coolant medium from top plate flange 440 (and buffer volumes 470) to an inlet port of a compressor via low-pressure inlet 414 and a high-pressure coolant medium from an outlet port of the compressor to top plate flange 440 via high-pressure inlet 412. As such, the rotary valve can generate an oscillating compression-expansion cycle of the coolant medium that facilitates reducing a temperature of 50-K stage 450 and 4-K stage flange 460.

To that end, high-pressure coolant medium from the rotary valve of motor head 420 flows towards 50-K stage flange 450 and 4-K stage flange 460. 50-K stage flange 450 and 4-K flange stage 460 facilitate heat exchange between the high-pressure coolant medium and the respective thermal stages. The high-pressure coolant medium transitions to low-pressure coolant medium via expansion. Heat from the respective thermal stages can be transferred with the low-pressure coolant medium as that coolant medium flows towards buffer volumes 470. By transferring heat away from the respective thermal stages, a reduction of temperature can occur at each thermal stage. The low-pressure coolant medium collected in buffer volumes 470 flows toward the inlet port of the compressor via the rotary valve of motor head 420 and low-pressure inlet 414 to close a cycle of the coolant medium between pulse tube system 400 and the compressor.

Figure 5:
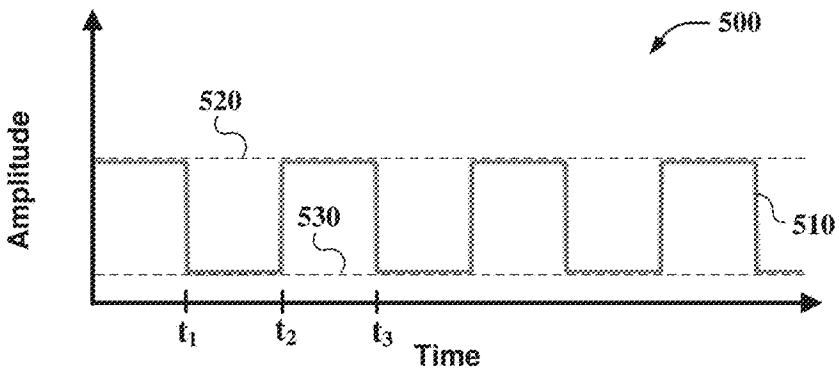
FIG. 5 illustrates an example, non-limiting graph depicting a non-linear drive signal.

Operation of some compressors can be controlled by non-linear drive signals as input. FIG. 5 illustrates an example, non-limiting graph 500 depicting a non-linear drive signal 510. As shown by FIG. 5, non-linear drive signal 510 can transition between a first amplitude level 520 and a second amplitude level 530 at each transition time. Responsive to receiving drive signal 510 at first amplitude level 520, a compressor can supply high-pressure coolant medium to a high-pressure inlet (e.g., high-pressure inlet 412) of a pulse tube system. Responsive to receiving drive signal 510 at second amplitude level 530, a compressor can pump low-pressure coolant medium from a low-pressure inlet (e.g., low-pressure inlet 414) of the pulse tube system.

As discussed above with respect to FIG. 4, coolant medium is alternatively transferred between a motor head and a top plate flange of the pulse tube system via a motor line coupling the motor head and the top plate flange by operation of a rotary valve within the motor head. In particular, the rotary valve alternately connects the top plate flange and/or associated buffer volumes with the high-pressure and low-pressure inlets to facilitate a flow of the coolant medium towards (at a high-pressure) and from (at a low-pressure) the top plate flange, respectively. Oscillating pressures in the coolant medium transferred between the motor head and the top plate flange via the motor line can generate low frequency pressure waves within the motor line. Such low frequency pressure waves within the motor line can impart low frequency mechanical vibrations on the top plate flange that can transfer to thermal stages of a cryostat via flanges (e.g., 50-K stage flange 450 and 4-K stage flange 460) of the pulse tube system that couple with the thermal stages to facilitate heat exchange.

Figure 6:
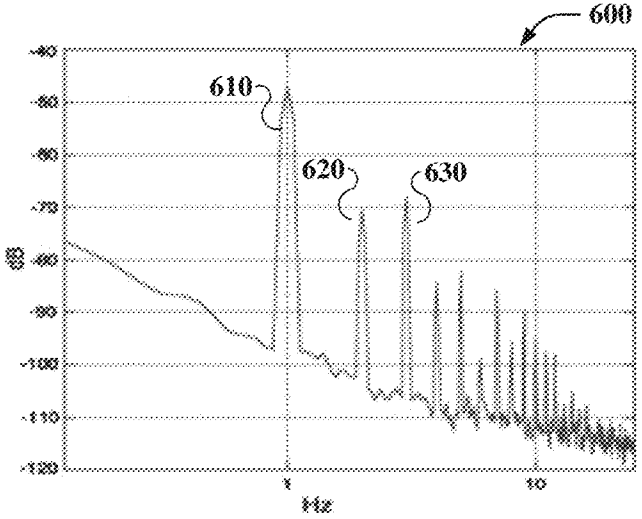
FIG. 6 illustrates an example, non-limiting graph depicting mechanical vibrations generated by a cryocooler driven by a non-linear drive signal.

FIG. 6 illustrates an example, non-limiting graph 600 depicting mechanical vibrations generated by a cryocooler driven by a non-linear drive signal (e.g., non-linear drive signal 510 of FIG. 5). As shown by graph 600, such mechanical vibrations can include a fundamental frequency component 610 centered at approximately 1 Hertz (Hz) and various harmonic components (e.g., harmonic components 620 and 630).

Figure 7:
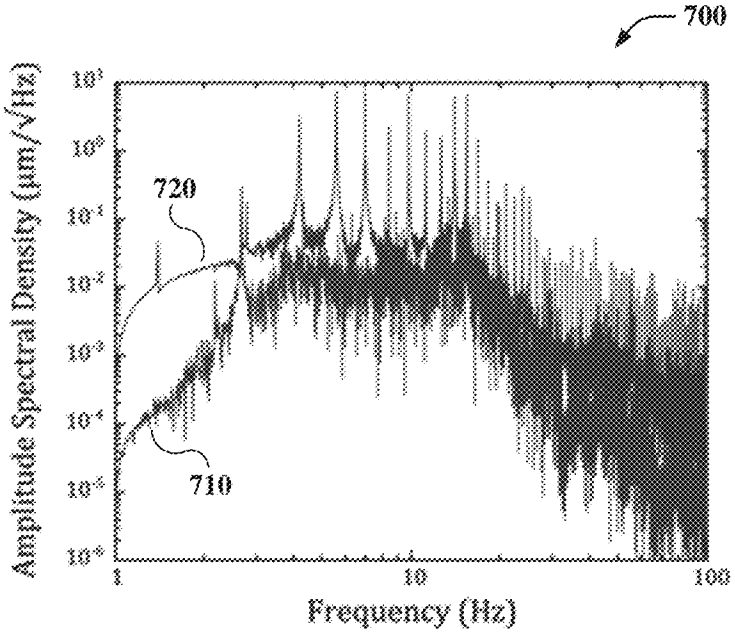
FIG. 7 illustrates an example, non-limiting graph depicting amplitude spectral density versus frequency.

FIG. 7 illustrates an example, non-limiting graph 700 depicting amplitude spectral density versus frequency. As shown by graph 700, such mechanical vibrations can persist without regard to whether a pulse tube system is operational. For example, waveform 710 corresponds to mechanical vibrations associated with a non-operational pulse tube system and waveform 720 corresponds to an operational pulse tube system.

Figure 8:
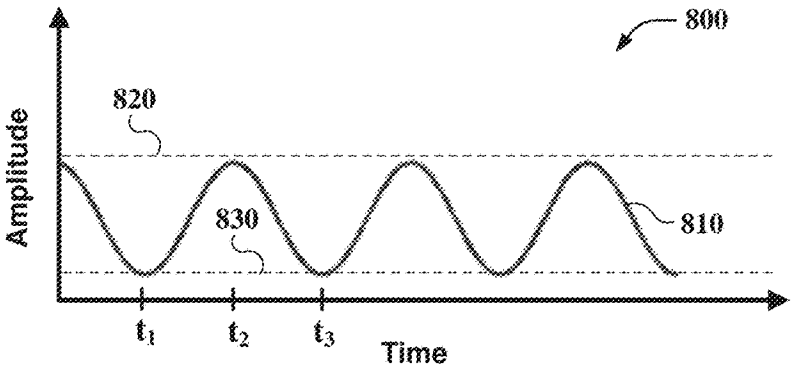
FIG. 8 illustrates an example, non-limiting graph depicting a linear drive signal, in accordance with one or more embodiments described herein.

In accordance with various embodiments disclosed herein, operation of a compressor associated with a cryocooler can be controlled using linear drive signals as input. FIG. 8 illustrates an example, non-limiting graph 800 depicting a linear drive signal 810. As shown by FIG. 8, non-linear drive signal 810 can transition between a first amplitude level 820 and a second amplitude level 830 at each transition time. Responsive to receiving drive signal 810 at first amplitude level 820, a compressor can supply high-pressure coolant medium to a high-pressure inlet (e.g., high-pressure inlet 412) of a pulse tube system. Responsive to receiving drive signal 810 at second amplitude level 830, a compressor can pump low-pressure coolant medium from a low-pressure inlet (e.g., low-pressure inlet 414) of the pulse tube system.

A comparison between FIGS. 5 and 8 illustrates an aspect of how linear drive signals can facilitate mitigating mechanical vibrations generated by a cryocooler by reducing a frequency of pressure waves within a motor line of a pulse tube system. For example, FIG. 5 shows that non-linear drive signal 500 can abruptly transition from a second amplitude level 530 to a first amplitude level 520 at transition time $t_2$. In this example, a compressor receiving non-linear drive signal 500 as input can abruptly transition from pumping low-pressure coolant medium from a low-pressure inlet of a pulse tube system to supplying high-pressure coolant medium to a high-pressure inlet of the pulse tube system. As such, oscillating pressures in the coolant medium transferred between a motor head and a top plate flange of the pulse tube system via a motor line can generate pressure waves within the motor line. Those pressure waves within the motor line can have a frequency that is associated with a rate at which the compressor switches from pumping low-pressure coolant medium from the low-pressure inlet to supplying high-pressure coolant medium to the high-pressure inlet. The pressure waves within the motor line can impart mechanical vibrations on the top plate flange that can transfer to thermal stages of a cryostat. Such mechanical vibrations can have a frequency that corresponds to the frequency of the pressure waves.

In contrast, a compressor receiving linear drive signal 800 as input can gradually switches from pumping low-pressure coolant medium from a low-pressure inlet to supplying high-pressure coolant medium to a high-pressure inlet. For example, FIG. 8 shows that linear drive signal 800 can steadily transition from a second amplitude level 830 to a first amplitude level 820 over a duration defined by transition time $t_1$ and transition time $t_2$. In this example, a compressor receiving linear drive signal 800 as input can gradually transition from pumping low-pressure coolant medium from a low-pressure inlet of a pulse tube system to supplying high-pressure coolant medium to a high-pressure inlet of the pulse tube system over the duration defined by transition time $t_1$ and transition time $t_2$. That gradual transition can facilitate dampening pressure waves within the motor line. As such, that gradual transition can facilitate mitigating mechanical vibrations that such pressure waves impart on the top plate flange that can transfer to thermal stages of a cryostat.

As discussed above with respect to FIG. 3, multiple pulse tube systems can be coupled with a cryostat. Each pulse tube system can be coupled with a compressor to form a cryocooler providing cooling capacity for the cryostat. Operation of each cryocooler can involve oscillating pressures in a coolant medium that generate pressure waves within a motor line of a given pulse tube system. As such, each cryocooler can represent a distinct source of mechanical vibrations imparted on thermal stages of the cryostat. Various embodiments disclosed herein can facilitate management of mechanical vibrations generated by multiple cryocoolers providing cooling capacity to a cryostat by modifying relative phases of linear drive signals. To that end, relative phases of linear drive signals controlling respective compressors of the multiple cryocoolers can be modified to facilitate asynchronous operation of those compressors.

Figure 9:
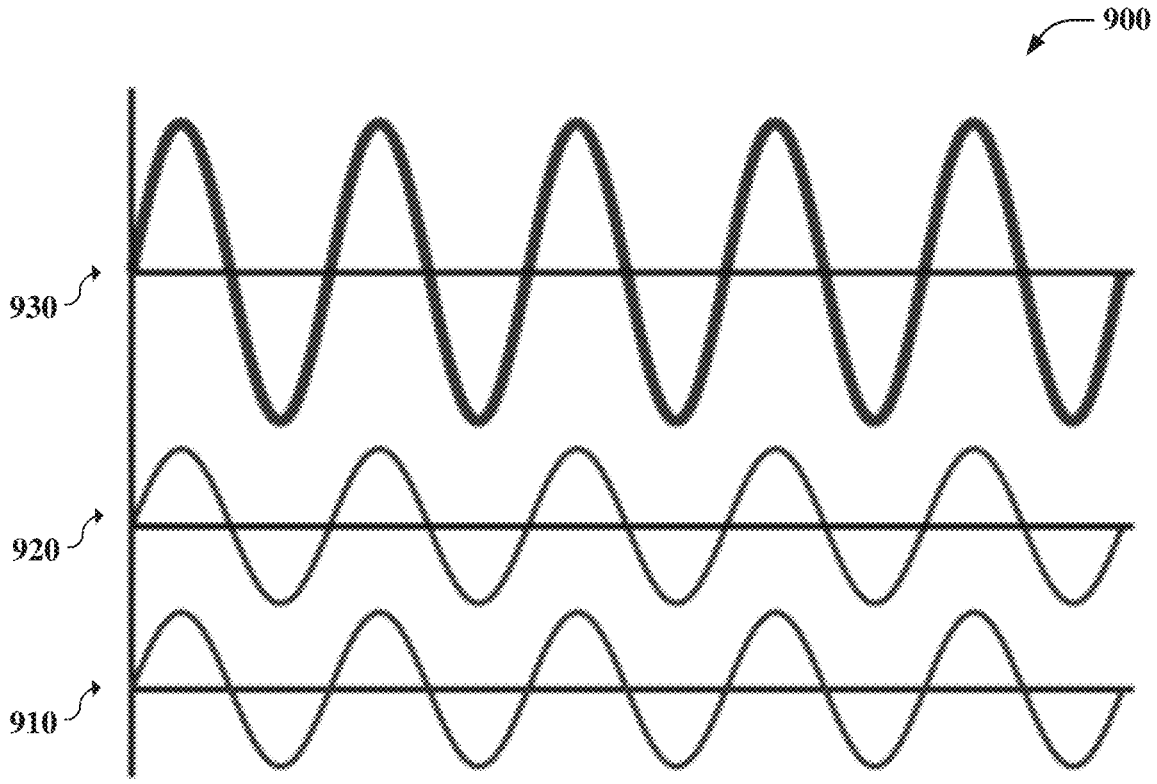
FIG. 9 illustrates an example, non-limiting graph depicting in-phase linear drive signals, in accordance with one or more embodiments described herein.

FIG. 9 illustrates an example, non-limiting graph 900 depicting in-phase linear drive signals, in accordance with one or more embodiments described herein. In FIG. 9, linear drive signal 910 can control operation of a first compressor associated with a cryocooler and linear drive signal 920 can control operation of a second compressor associated with the cryostat. As shown by FIG. 9, linear drive signals 910 and 920 are in-phase. Accordingly, linear drive signals 910 and 920 can facilitate synchronous operation of the first and second compressors. By operating synchronously, the first and second compressors can synchronously impart mechanical vibrations on thermal stages of the cryostat.

A magnitude of the synchronously imparted mechanical vibrations can be greater than a sum of the respective magnitudes of mechanical vibrations imparted by the first and second compressors. One aspect of that additional mechanical vibration magnitude realized by synchronously operating the first and second compressors relates to constructive interference. For example, the first and second compressors can be construed as a common vibrational source from the perspective of the cryostat. That common vibrational source would be driven by a linear drive signal 930 having a greater amplitude than the respective amplitudes of linear drive signals 910 and 920 combined. That greater amplitude of linear drive signal 930 results from constructive interference created by virtue of linear drive signals 910 and 920 being in-phase. The greater amplitude of the linear drive signal 930 driving the common vibrational source can correspond with a higher magnitude of mechanical vibrations imparted on the cryostat.

Figure 10:
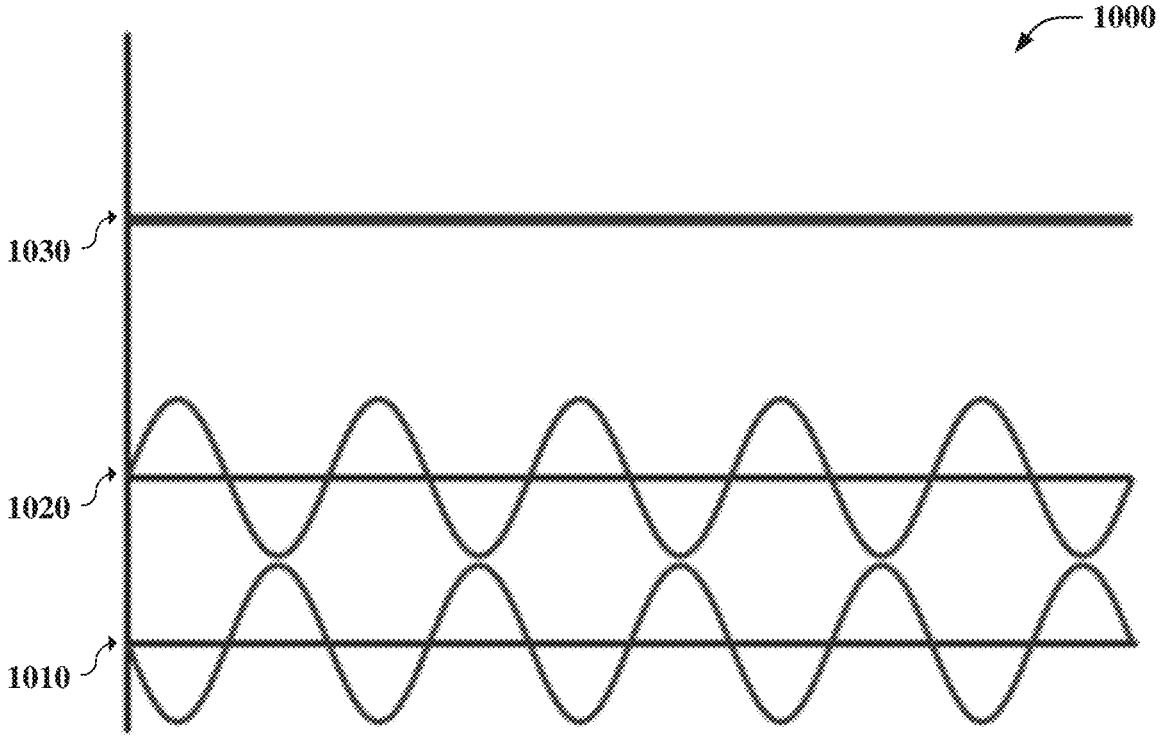
FIG. 10 illustrates an example, non-limiting graph depicting out-of-phase linear drive signals, in accordance with one or more embodiments described herein.

FIG. 10 illustrates an example, non-limiting graph 1000 depicting out-of-phase linear drive signals, in accordance with one or more embodiments described herein. In FIG. 10, linear drive signal 1010 can control operation of a first compressor associated with a cryocooler and linear drive signal 1020 can control operation of a second compressor associated with the cryostat. As shown by FIG. 10, linear drive signals 1010 and 1020 are out-of-phase by 180 degrees. Accordingly, linear drive signals 1010 and 1020 can facilitate asynchronous operation of the first and second compressors. By operating asynchronously, the first and second compressors can asynchronously impart mechanical vibrations on thermal stages of the cryostat.

A magnitude of the asynchronously imparted mechanical vibrations can be less than a sum of the respective magnitudes of mechanical vibrations imparted by the first and second compressors. One aspect of that reduced mechanical vibration magnitude realized by asynchronously operating the first and second compressors relates to destructive interference. For example, the first and second compressors can be construed as a common vibrational source from the perspective of the cryostat. That common vibrational source would be driven by a linear drive signal 1030 having a lower amplitude than the respective amplitudes of linear drive signals 1010 and 1020 combined. That lower amplitude of linear drive signal 1030 results from destructive interference created by virtue of linear drive signals 1010 and 1020 out-of-phase by 180 degrees. The lower amplitude of the linear drive signal 1030 driving the common vibrational source can correspond with a lower magnitude of mechanical vibrations imparted on the cryostat.

Figure 11:
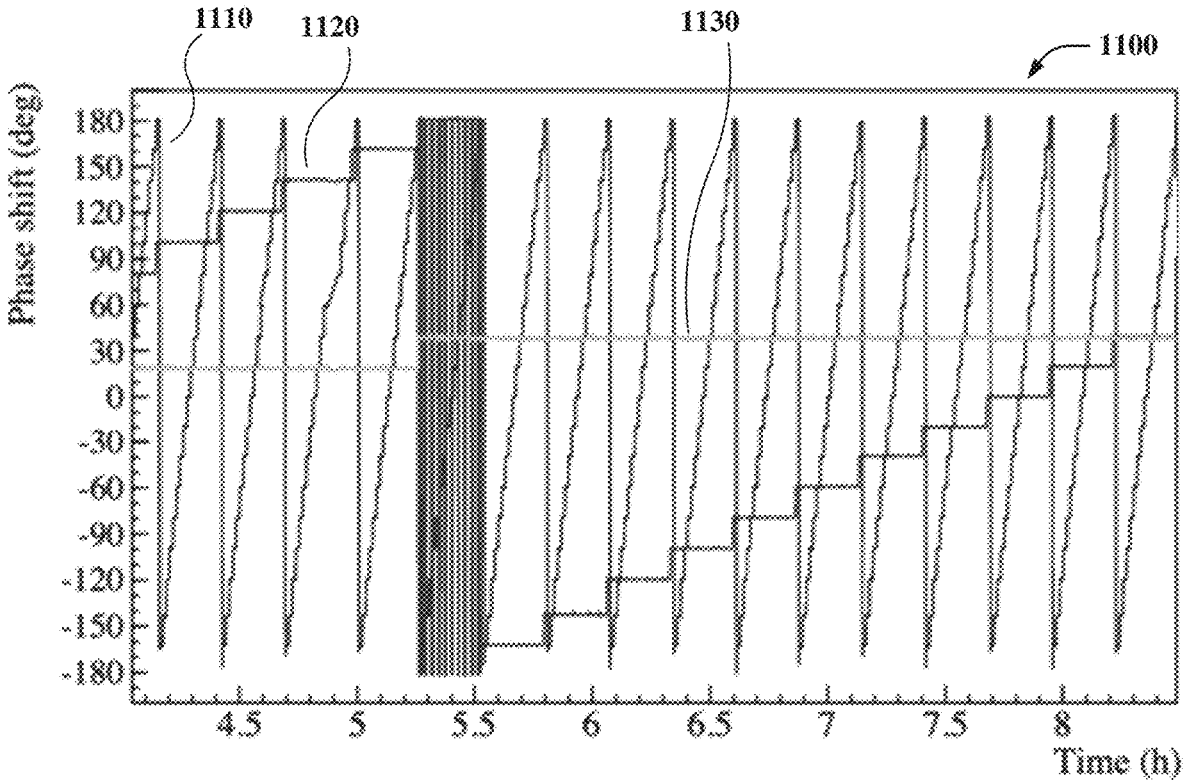
FIG. 11 illustrates an example, non-limiting graph depicting relative phase shifts between multiple linear drive signals, in accordance with one or more embodiments described herein.

FIG. 11 illustrates an example, non-limiting graph 1100 depicting relative phase shifts between multiple linear drive signals, in accordance with one or more embodiments described herein. In particular, line 1110 corresponds to a phase of a first linear drive signal, line 1120 corresponds to a phase of a second linear drive signal, and line 1130 corresponds to a phase of a third linear drive signal.

Figure 12:
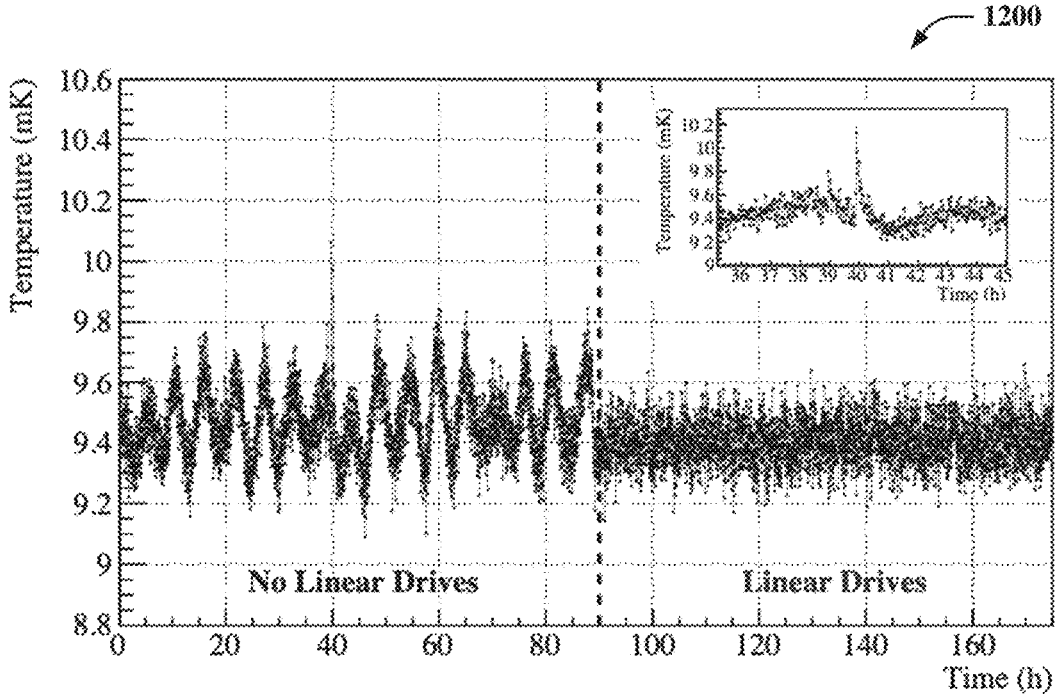
FIG. 12 illustrates an example, non-limiting graph depicting temperature of a Mixing Chamber stage versus time, in accordance with one or more embodiments described herein.

FIG. 12 illustrates an example, non-limiting graph 1200 depicting temperature of a Mixing Chamber stage versus time, in accordance with one or more embodiments described herein. Graph 1200 shows that controlling compressor operation using linear drive signals can facilitate improving a stability of the temperature of the Mixing Chamber stage than can be achieved using non-linear drive signals.

Figure 13:
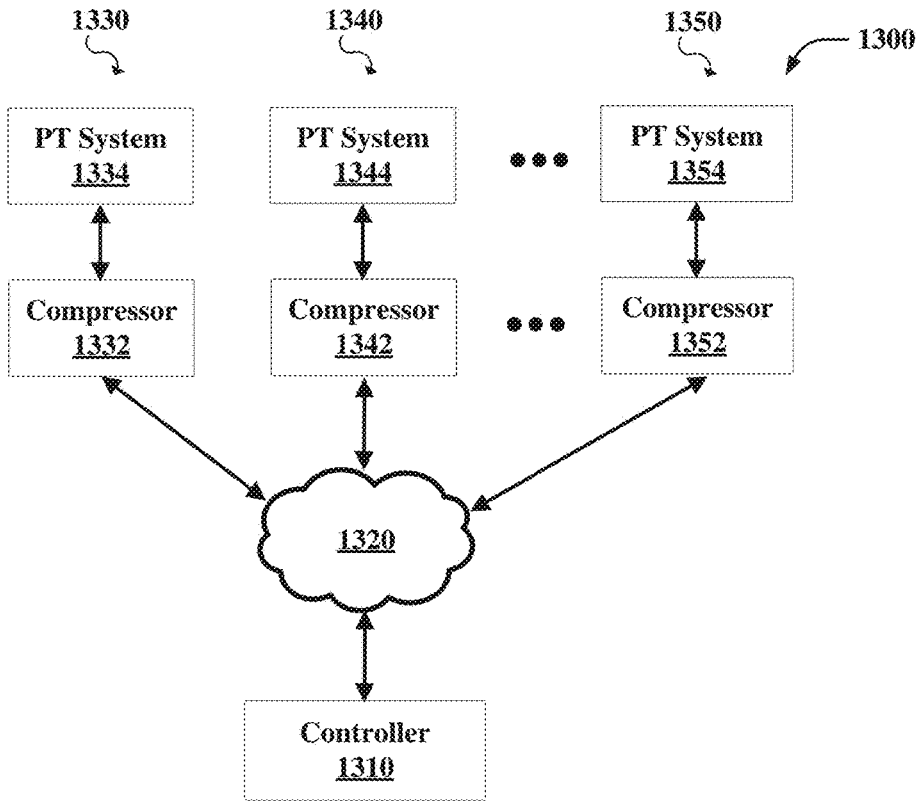
FIG. 13 illustrates a block diagram of an example, non-limiting system that can facilitate mechanical vibration management for cryogenic environments, in accordance with one or more embodiments described herein.

FIG. 13 illustrates a block diagram of an example, non-limiting system 1300 that can facilitate mechanical vibration management for cryogenic environments, in accordance with one or more embodiments described herein. System 1300 includes controller 1310, cryocooler 1330, cryocooler 1340, and cryocooler 1350. Cryocoolers 1330, 1340, and 1350 can each provide cooling capacity for a cryogenic environment (e.g., cryostat 200 of FIGS. 2-3). To that end, a pulse tube system of each regenerative cryocooler can be coupled to the cryogenic environment. For example, pulse tube systems 1334, 1344, and/or 1354 can each be coupled to the cryogenic environment as illustrated in FIG. 3. In an embodiment, pulse tube systems 1334, 1344, and/or 1354 can be implemented using pulse tube system 400 of FIG. 4. In an embodiment, cryocoolers 1330, 1340, and/or 1350 can be a regenerative cryocooler. In an embodiment, cryocoolers 1330, 1340, and/or 1350 can be a Stirling cryocooler, a pulse tube cryocooler, and/or a Gifford McMahon cryocooler.

Each cryocooler can include a compressor that supplies high-pressure coolant medium to a high-pressure inlet (e.g., high-pressure inlet 412 of FIG. 4) of a corresponding pulse tube system and pumps low-pressure coolant medium from a low-pressure inlet (e.g., low-pressure inlet 414) responsive to a drive signal. For example, compressor 1332 can exchange a coolant medium with pulse tube system 1334, compressor 1342 can exchange a coolant medium with pulse tube system 1344, and compressor 1352 can exchange a coolant medium with pulse tube system 1354. Each compressor can receive a corresponding drive signal from controller 1310 via a network 1320 that communicatively couples controller 1310 with each compressor.

In operation, controller 1310 can centrally orchestrate (or manage) operation of cryocoolers 1330, 1340, and 1350 using linear drive signals that dynamically control operation of each respective compressor. By centrally orchestrating operation of each cryocooler, controller 1310 can facilitate reducing mechanical vibrations associated with the cryogenic environment. Centrally orchestrating operation of each cryocooler can include controller 1310 identifying (e.g., with monitor component 170) an operational state of each cryocooler.

Controller 1310 can identify the operational state of each cryocooler by evaluating one or more operational parameters of each cryocooler. Example operational parameters can include a low-pressure level of a coolant medium, a high-pressure level of the coolant medium, a pressure differential, a compressor temperature, a cold head temperature, a cold head vibration level, or a combination thereof. In an embodiment, controller 1310 can receive data indicative of the one or more operational parameters of each cryocooler via network 1320. Controller 1310 can evaluate the one or more operational parameters using a predefined threshold value and/or a predefined tolerance range for that threshold value for each operational parameter.

If such evaluation determines that the one or more operational parameters for a given cryocooler each satisfy a corresponding predefined threshold value and/or a corresponding predefined tolerance range for that threshold value, controller 1310 can identify an operational state of the given cryocooler as being a healthy operational state. When controller 1310 identifies the given cryocooler as being in the healthy operational state, controller 1310 can permit a respective compressor of the given cryocooler to continue operation.

If such evaluation determines that, at least, one operational parameter among the one or more operational parameters for a given cryocooler fails to satisfy a corresponding predefined threshold value and/or a corresponding predefined tolerance range for that threshold value, controller 1310 can identify an operational state of the given cryocooler as being a failing operational state. When controller 1310 identifies the given cryocooler as being in the failing operational state, controller 1310 can modify a linear drive signal of a respective compressor of the given cryocooler to terminate operation of that compressor.

By way of example, at a first time, controller 1310 can evaluate respective operational parameters of cryocoolers 1330, 1340, and 1350. Through such evaluation at the first time, controller 1310 can identify cryocoolers 1330, 1340, and 1350 as each being in a healthy operational state. Accordingly, at the first time, controller 1310 can permit respective compressors of cryocoolers 1330, 1340, and 1350 to continue operation. At a second time after the first time, controller 1310 can again evaluate respective operational parameters of cryocoolers 1330, 1340, and 1350. Through such evaluation at the second time, controller 1310 can identify cryocoolers 1330 and 1350 as each being in a healthy operational state. Accordingly, at the second time, controller 1310 can permit compressors 1332 and 1352 of cryocoolers 1330 and 1350, respectively, to continue operation. However, controller 1310 can determine that cryocooler 1340 has transitioned from a healthy operational state to a failing operational state from that evaluation at the second time. As such, controller 1310 can modify a linear drive signal of compressor 1342 to terminate operation of compressor 1342 at the second time. For example, controller 1310 can modify the linear drive signal of compressor 1342 to an amplitude value that causes compressor 1342 to cease exchanging a coolant medium with pulse tube system 1344.

Figure 14:
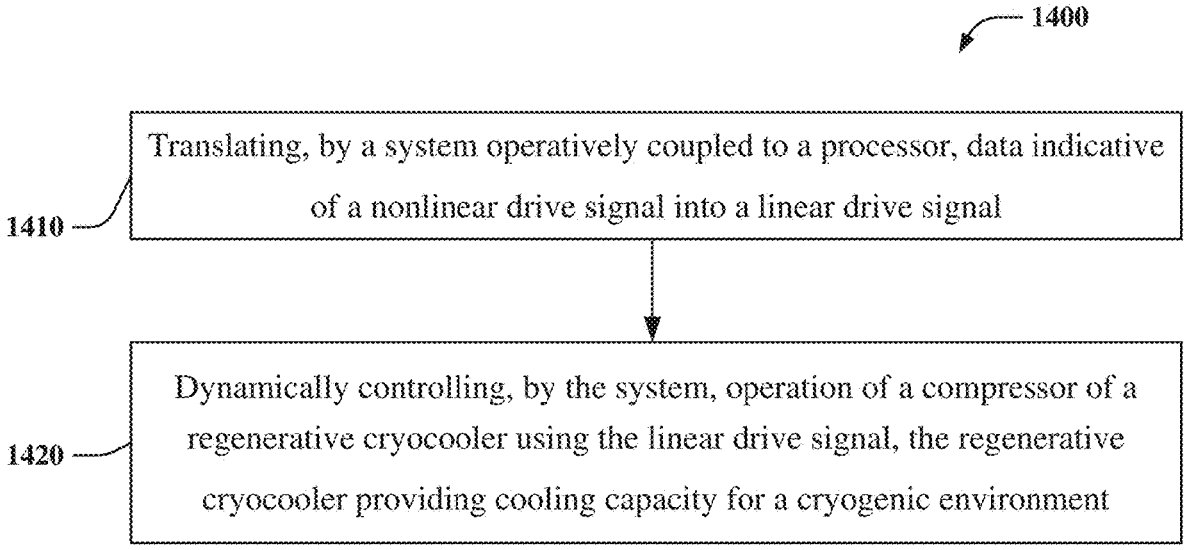
FIG. 14 illustrates a flow diagram of an example, non-limiting computer-implemented method of facilitating mechanical vibration management for cryogenic environments, in accordance with one or more embodiments described herein.

FIG. 14 illustrates a flow diagram of an example, non-limiting computer-implemented method 1400 of facilitating mechanical vibration management for cryogenic environments, in accordance with one or more embodiments described herein. Repetitive description of like elements employed in other embodiments described herein is omitted for sake of brevity. At 1410, the computer-implemented method 1400 can comprise translating (e.g., with linearization component 140), by a system operatively coupled to a processor, data indicative of a nonlinear drive signal into a linear drive signal. At 1420, the computer-implemented method 1400 can comprise dynamically controlling, by the system (e.g., with drive component 150), operation of a compressor of a cryocooler using the linear drive signal. The cryocooler can provide cooling capacity for a cryogenic environment. In an embodiment, the cryocooler can be a regenerative cryocooler. In an embodiment, the cryocooler can be a Stirling cryocooler, a pulse tube cryocooler, and/or a Gifford McMahon cryocooler.

In an embodiment, the computer-implemented method 1400 can further comprise: modifying, by the system (e.g., with asynchronization component 160), a phase of the linear drive signal relative to a corresponding phase of a drive signal associated with an additional cryocooler based on a feedback signal generated using sensor data indicative of mechanical vibrations associated with the cryogenic environment. The drive signal can control operation of a corresponding compressor of the additional cryocooler that provides cooling capacity for the cryogenic environment. In an embodiment, modifying the phase of the linear drive signal can facilitate asynchronous operation of the compressor and the corresponding compressor. In an embodiment, modifying the phase of the linear drive signal can facilitate management of mechanical vibrations generated by the cryocooler.

In an embodiment, the computer-implemented method 1400 can further comprise: generating, by the system (e.g., with monitor component 170), a feedback signal using sensor data indicative of mechanical vibrations associated with the cryogenic environment. In an embodiment, the computer-implemented method 1400 can further comprise: identifying, by the system (e.g., with monitor component 170), an operational state of the cryocooler by evaluating an operational parameter of the cryocooler. In an embodiment, the operational parameter can include: a low-pressure level of a coolant medium, a high-pressure level of the coolant medium, a pressure differential, a compressor temperature, a cold head temperature, a cold head vibration level, or a combination thereof.

In an embodiment, the computer-implemented method 1400 can further comprise: modifying, by the system (e.g., with drive component 150), the linear drive signal to terminate operation of the compressor when an operational state of the cryocooler transitions from a healthy operational state to a failing operational state.

Figure 15:
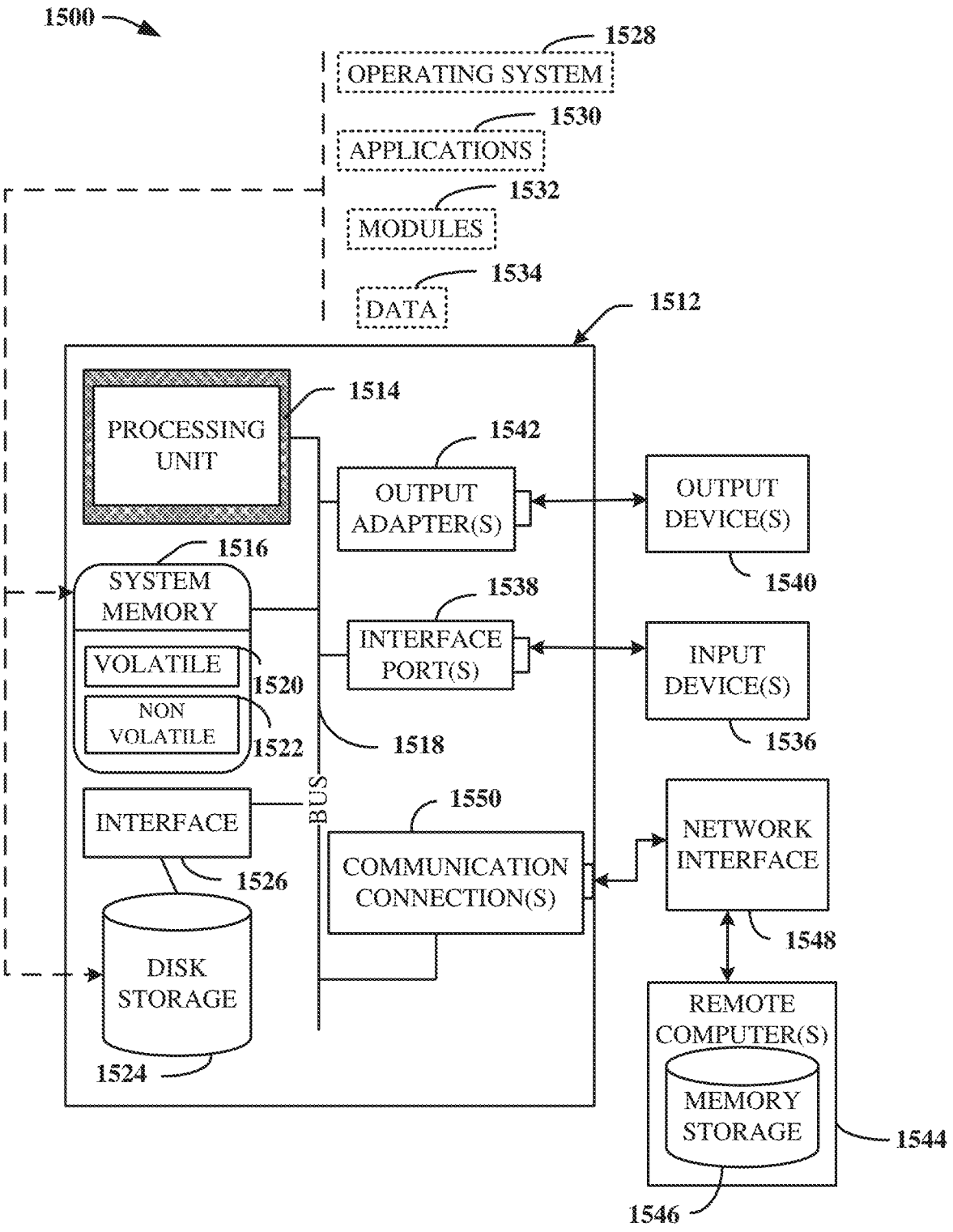
FIG. 15 illustrates a block diagram of an example, non-limiting operating environment in which one or more embodiments described herein can be facilitated.

In order to provide a context for the various aspects of the disclosed subject matter, FIG. 15 as well as the following discussion are intended to provide a general description of a suitable environment in which the various aspects of the disclosed subject matter can be implemented. FIG. 15 illustrates a suitable operating environment 1500 for implementing various aspects of this disclosure can also include a computer 1512. The computer 1512 can also include a processing unit 1514, a system memory 1516, and a system bus 1518. The system bus 1518 couples system components including, but not limited to, the system memory 1516 to the processing unit 1514. The processing unit 1514 can be any of various available processors. Dual microprocessors and other multiprocessor architectures also can be employed as the processing unit 1514. The system bus 1518 can be any of several types of bus structure(s) including the memory bus or memory controller, a peripheral bus or external bus, and/or a local bus using any variety of available bus architectures including, but not limited to, Industrial Standard Architecture (ISA), Micro-Channel Architecture (MSA), Extended ISA (EISA), Intelligent Drive Electronics (IDE), VESA Local Bus (VLB), Peripheral Component Interconnect (PCI), Card Bus, Universal Serial Bus (USB), Advanced Graphics Port (AGP), Firewire (IEEE 1094), and Small Computer Systems Interface (SCSI). The system memory 1516 can also include volatile memory 1520 and nonvolatile memory 1522. The basic input/output system (BIOS), containing the basic routines to transfer information between elements within the computer 1512, such as during start-up, is stored in nonvolatile memory 1522. By way of illustration, and not limitation, nonvolatile memory 1522 can include read only memory (ROM), programmable ROM (PROM), electrically programmable ROM (EPROM), electrically erasable programmable ROM (EEPROM), flash memory, or nonvolatile random-access memory (RAM) (e.g., ferroelectric RAM (FeRAM). Volatile memory 1520 can also include random access memory (RAM), which acts as external cache memory. By way of illustration and not limitation, RAM is available in many forms such as static RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), direct Rambus RAM (DRRAM), direct Rambus dynamic RAM (DRDRAM), and Rambus dynamic RAM.

Computer 1512 can also include removable/non-removable, volatile/non-volatile computer storage media. FIG. 15 illustrates, for example, a disk storage 1524. Disk storage 1524 can also include, but is not limited to, devices like a magnetic disk drive, floppy disk drive, tape drive, Jaz drive, Zip drive, LS-100 drive, flash memory card, or memory stick. The disk storage 1524 also can include storage media separately or in combination with other storage media including, but not limited to, an optical disk drive such as a compact disk ROM device (CD-ROM), CD recordable drive (CD-R Drive), CD rewritable drive (CD-RW Drive) or a digital versatile disk ROM drive (DVD-ROM). To facilitate connection of the disk storage 1524 to the system bus 1518, a removable or non-removable interface is typically used, such as interface 1526. FIG. 15 also depicts software that acts as an intermediary between users and the basic computer resources described in the suitable operating environment 1500. Such software can also include, for example, an operating system 1528. Operating system 1528, which can be stored on disk storage 1524, acts to control and allocate resources of the computer 1512. System applications 1530 take advantage of the management of resources by operating system 1528 through program modules 1532 and program data 1534, e.g., stored either in system memory 1516 or on disk storage 1524. It is to be appreciated that this disclosure can be implemented with various operating systems or combinations of operating systems. A user enters commands or information into the computer 1512 through input device(s) 1536. Input devices 1536 include, but are not limited to, a pointing device such as a mouse, trackball, stylus, touch pad, keyboard, microphone, joystick, game pad, satellite dish, scanner, TV tuner card, digital camera, digital video camera, web camera, and the like. These and other input devices connect to the processing unit 1514 through the system bus 1518 via interface port(s) 1538. Interface port(s) 1538 include, for example, a serial port, a parallel port, a game port, and a universal serial bus (USB). Output device(s) 1540 use some of the same type of ports as input device(s) 1536. Thus, for example, a USB port can be used to provide input to computer 1512, and to output information from computer 1512 to an output device 1540. Output adapter 1542 is provided to illustrate that there are some output devices 1540 like monitors, speakers, and printers, among other output devices 1540, which require special adapters. The output adapters 1542 include, by way of illustration and not limitation, video and sound cards that provide a means of connection between the output device 1540 and the system bus 1518. It can be noted that other devices and/or systems of devices provide both input and output capabilities such as remote computer(s) 1544.

Computer 1412 can operate in a networked environment using logical connections to one or more remote computers, such as remote computer(s) 1544. The remote computer(s) 1544 can be a computer, a server, a router, a network PC, a workstation, a microprocessor-based appliance, a peer device or other common network node and the like, and typically can also include many or the elements described relative to computer 1512. For purposes of brevity, only a memory storage device 1546 is illustrated with remote computer(s) 1544. Remote computer(s) 1544 is logically connected to computer 1512 through a network interface 1548 and then physically connected via communication connection 1550. Network interface 1548 encompasses wire and/or wireless communication networks such as local-area networks (LAN), wide-area networks (WAN), cellular networks, etc. LAN technologies include Fiber Distributed Data Interface (FDDI), Copper Distributed Data Interface (CDDI), Ethernet, Token Ring and the like. WAN technologies include, but are not limited to, point-to-point links, circuit switching networks like Integrated Services Digital Networks (ISDN) and variations thereon, packet switching networks, and Digital Subscriber Lines (DSL). Communication connection(s) 1550 refers to the hardware/software employed to connect the network interface 1548 to the system bus 1518. While communication connection 1550 is shown for illustrative clarity inside computer 1512, it can also be external to computer 1512. The hardware/software for connection to the network interface 1548 can also include, for exemplary purposes only, internal and external technologies such as, modems including regular telephone grade modems, cable modems and DSL modems, ISDN adapters, and Ethernet cards.

The present invention may be a system, a method, an apparatus and/or a computer program product at any possible technical detail level of integration. The computer program product can include a computer readable storage medium (or media) having computer readable program instructions thereon for causing a processor to carry out aspects of the present invention. The computer readable storage medium can be a tangible device that can retain and store instructions for use by an instruction execution device. The computer readable storage medium can be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium can also include the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network can comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device. Computer readable program instructions for carrying out operations of the present invention can be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions can execute entirely on the user's computer, partly on the user's computer, as a stand-alone software package, partly on the user's computer and partly on a remote computer or entirely on the remote computer or server. In the latter scenario, the remote computer can be connected to the user's computer through any type of network, including a local area network (LAN) or a wide area network (WAN), or the connection can be made to an external computer (for example, through the Internet using an Internet Service Provider). In some embodiments, electronic circuitry including, for example, programmable logic circuitry, field-programmable gate arrays (FPGA), or programmable logic arrays (PLA) can execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions. These computer readable program instructions can be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions can also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks. The computer readable program instructions can also be loaded onto a computer, other programmable data processing apparatus, or other device to cause a series of operational acts to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams can represent a module, segment, or portion of instructions, which comprises one or more executable instructions for implementing the specified logical function(s). In some alternative implementations, the functions noted in the blocks can occur out of the order noted in the Figures. For example, two blocks shown in succession can, in fact, be executed substantially concurrently, or the blocks can sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

While the subject matter has been described above in the general context of computer-executable instructions of a computer program product that runs on a computer and/or computers, those skilled in the art will recognize that this disclosure also can or can be implemented in combination with other program modules. Generally, program modules include routines, programs, components, data structures, etc. that perform particular tasks and/or implement particular abstract data types. Moreover, those skilled in the art will appreciate that the inventive computer-implemented methods can be practiced with other computer system configurations, including single-processor or multiprocessor computer systems, mini-computing devices, mainframe computers, as well as computers, hand-held computing devices (e.g., PDA, phone), microprocessor-based or programmable consumer or industrial electronics, and the like. The illustrated aspects can also be practiced in distributed computing environments in which tasks are performed by remote processing devices that are linked through a communications network. However, some, if not all aspects of this disclosure can be practiced on stand-alone computers. In a distributed computing environment, program modules can be located in both local and remote memory storage devices. For example, in one or more embodiments, computer executable components can be executed from memory that can include or be comprised of one or more distributed memory units. As used herein, the term "memory" and "memory unit" are interchangeable. Further, one or more embodiments described herein can execute code of the computer executable components in a distributed manner, e.g., multiple processors combining or working cooperatively to execute code from one or more distributed memory units. As used herein, the term "memory" can encompass a single memory or memory unit at one location or multiple memories or memory units at one or more locations.

As used in this application, the terms "component," "system," "platform," "interface," and the like, can refer to and/or can include a computer-related entity or an entity related to an operational machine with one or more specific functionalities. The entities disclosed herein can be either hardware, a combination of hardware and software, software, or software in execution. For example, a component can be, but is not limited to being, a process running on a processor, a processor, an object, an executable, a thread of execution, a program, and/or a computer. By way of illustration, both an application running on a server and the server can be a component. One or more components can reside within a process and/or thread of execution and a component can be localized on one computer and/or distributed between two or more computers. In another example, respective components can execute from various computer readable media having various data structures stored thereon. The components can communicate via local and/or remote processes such as in accordance with a signal having one or more data packets (e.g., data from one component interacting with another component in a local system, distributed system, and/or across a network such as the Internet with other systems via the signal). As another example, a component can be an apparatus with specific functionality provided by mechanical parts operated by electric or electronic circuitry, which is operated by a software or firmware application executed by a processor. In such a case, the processor can be internal or external to the apparatus and can execute at least a part of the software or firmware application. As yet another example, a component can be an apparatus that provides specific functionality through electronic components without mechanical parts, wherein the electronic components can include a processor or other means to execute software or firmware that confers at least in part the functionality of the electronic components. In an aspect, a component can emulate an electronic component via a virtual machine, e.g., within a cloud computing system.

In addition, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Moreover, articles "a" and "an" as used in the subject specification and annexed drawings should generally be construed to mean "one or more" unless specified otherwise or clear from context to be directed to a singular form. As used herein, the terms "example" and/or "exemplary" are utilized to mean serving as an example, instance, or illustration. For the avoidance of doubt, the subject matter disclosed herein is not limited by such examples. In addition, any aspect or design described herein as an "example" and/or "exemplary" is not necessarily to be construed as preferred or advantageous over other aspects or designs, nor is it meant to preclude equivalent exemplary structures and techniques known to those of ordinary skill in the art.

As it is employed in the subject specification, the term "processor" can refer to substantially any computing processing unit or device comprising, but not limited to, single-core processors; single-processors with software multithread execution capability; multi-core processors; multi-core processors with software multithread execution capability; multi-core processors with hardware multithread technology; parallel platforms; and parallel platforms with distributed shared memory. Additionally, a processor can refer to an integrated circuit, an application specific integrated circuit (ASIC), a digital signal processor (DSP), a field programmable gate array (FPGA), a programmable logic controller (PLC), a complex programmable logic device (CPLD), a discrete gate or transistor logic, discrete hardware components, or any combination thereof designed to perform the functions described herein. Further, processors can exploit nano-scale architectures such as, but not limited to, molecular and quantum-dot based transistors, switches and gates, in order to optimize space usage or enhance performance of user equipment. A processor can also be implemented as a combination of computing processing units. In this disclosure, terms such as "store," "storage," "data store," data storage," "database," and substantially any other information storage component relevant to operation and functionality of a component are utilized to refer to "memory components," entities embodied in a "memory," or components comprising a memory. It is to be appreciated that memory and/or memory components described herein can be either volatile memory or nonvolatile memory, or can include both volatile and nonvolatile memory. By way of illustration, and not limitation, nonvolatile memory can include read only memory (ROM), programmable ROM (PROM), electrically programmable ROM (EPROM), electrically erasable ROM (EEPROM), flash memory, or nonvolatile random access memory (RAM) (e.g., ferroelectric RAM (FeRAM). Volatile memory can include RAM, which can act as external cache memory, for example. By way of illustration and not limitation, RAM is available in many forms such as synchronous RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), direct Rambus RAM (DRRAM), direct Rambus dynamic RAM (DRDRAM), and Rambus dynamic RAM (RDRAM). Additionally, the disclosed memory components of systems or computer-implemented methods herein are intended to include, without being limited to including, these and any other suitable types of memory.

What has been described above include mere examples of systems and computer-implemented methods. It is, of course, not possible to describe every conceivable combination of components or computer-implemented methods for purposes of describing this disclosure, but one of ordinary skill in the art can recognize that many further combinations and permutations of this disclosure are possible. Furthermore, to the extent that the terms "includes," "has," "possesses," and the like are used in the detailed description, claims, appendices and drawings such terms are intended to be inclusive in a manner similar to the term "comprising" as "comprising" is interpreted when employed as a transitional word in a claim.

The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A system, comprising:

a processor that executes the following computer-executable components stored in memory:

a linearization component that translates data indicative of a nonlinear drive signal into a linear drive signal;

a drive component that dynamically controls operation of a compressor of a cryocooler using the linear drive signal, the cryocooler providing cooling capacity for a cryogenic environment; and an asynchronization component that modifies a phase of the linear drive signal relative to a corresponding phase of a drive signal associated with an additional cryocooler, wherein the drive signal controls operation of a corresponding compressor of the additional cryocooler that provides cooling capacity for the cryogenic environment.

2. The system of claim 1, wherein the asynchronization component modifies the phase of the linear drive signal based on a feedback signal generated using sensor data indicative of mechanical vibrations associated with the cryogenic environment.

3. The system of claim 1, wherein the asynchronization component modifies the phase of the linear drive signal to facilitate asynchronous operation of the compressor and the corresponding compressor.

4. The system of claim 1, further comprising:

a monitor component that generates a feedback signal using sensor data indicative of mechanical vibrations associated with the cryogenic environment.

5. The system of claim 4, wherein the monitor component identifies an operational state of the cryocooler by evaluating an operational parameter of the cryocooler.

6. The system of claim 5, wherein the operational parameter includes: a low-pressure level of a coolant medium, a high-pressure level of the coolant medium, a pressure differential, a compressor temperature, a cold head temperature, a cold head vibration level, or a combination thereof.

7. The system of claim 1, wherein the drive component modifies the linear drive signal to terminate operation of the compressor when an operational state of the cryocooler transitions from a healthy operational state to a failing operational state.

8. A computer-implemented method comprising:

translating, by a system operatively coupled to a processor, data indicative of a nonlinear drive signal into a linear drive signal;

dynamically controlling, by the system, operation of a compressor of a cryocooler using the linear drive signal, the cryocooler providing cooling capacity for a cryogenic environment; and modifying, by the system, a phase of the linear drive signal relative to a corresponding phase of a drive signal associated with an additional cryocooler, wherein the drive signal controls operation of a corresponding compressor of the additional cryocooler that provides cooling capacity for the cryogenic environment.

9. The computer-implemented method of claim 8, wherein the cryocooler is among a plurality of cryocoolers providing cooling capacity for the cryogenic environment, and wherein the system centrally orchestrates operation of respective compressors of the plurality of cryocoolers to facilitate reducing mechanical vibrations associated with the cryogenic environment.

10. The computer-implemented method of claim 8, wherein the modifying comprises modifying the phase of the linear drive signal based on a feedback signal generated using sensor data indicative of mechanical vibrations associated with the cryogenic environment.

11. The computer-implemented method of claim 8, wherein modifying the phase of the linear drive signal facilitates asynchronous operation of the compressor and the corresponding compressor.

12. The computer-implemented method of claim 8, wherein modifying the phase of the linear drive signal facilitates management of mechanical vibrations generated by the cryocooler.

13. The computer-implemented method of claim 8, further comprising:

generating, by the system, a feedback signal using sensor data indicative of mechanical vibrations associated with the cryogenic environment.

14. The computer-implemented method of claim 8, further comprising:

identifying, by the system, an operational state of the cryocooler by evaluating an operational parameter of the cryocooler.

15. The computer-implemented method of claim 14, wherein the operational parameter includes: a low-pressure level of a coolant medium, a high-pressure level of the coolant medium, a pressure differential, a compressor temperature, a cold head temperature, a cold head vibration level, or a combination thereof.

16. The computer-implemented method of claim 8, further comprising:

further modifying, by the system, the linear drive signal to terminate operation of the compressor when an operational state of the cryocooler transitions from a healthy operational state to a failing operational state.

17. A computer program product comprising a computer readable storage medium having program instructions embodied therewith, the program instructions executable by a processor to cause the processor to:

translate, by the processor, data indicative of a nonlinear drive signal into a linear drive signal;

dynamically control, by the processor, operation of a compressor of a cryocooler using the linear drive signal, the cryocooler providing cooling capacity for a cryogenic environment; and modify, by the processor, a phase of the linear drive signal relative to a corresponding phase of a drive signal associated with an additional cryocooler, wherein the drive signal controls operation of a corresponding compressor of the additional cryocooler that provides cooling capacity for the cryogenic environment.

18. The computer program product of claim 17, the program instructions executable by the processor to further cause the processor to:

modify, by the processor, the phase of the linear drive signal based on a feedback signal generated using sensor data indicative of mechanical vibrations associated with the cryogenic environment.

19. The computer program product of claim 17, wherein modifying the phase of the linear drive signal facilitates asynchronous operation of the compressor and the corresponding compressor.

20. The computer program product of claim 17, the program instructions executable by the processor to further cause the processor to:

further modify, by the processor, the linear drive signal to terminate operation of the compressor when an operational state of the cryocooler transitions from a healthy operational state to a failing operational state.

* * * * *